US011602873B2

(12) United States Patent
Merrill

(10) Patent No.: US 11,602,873 B2
(45) Date of Patent: Mar. 14, 2023

(54) EXTENDED GAUGE FOR A TILE SAW

(71) Applicant: Deloy Merrill, St. George, UT (US)

(72) Inventor: Deloy Merrill, St. George, UT (US)

( * ) Notice: Subject to any disclaimer, the term of this patent is extended or adjusted under 35 U.S.C. 154(b) by 0 days.

(21) Appl. No.: 17/816,881

(22) Filed: Aug. 2, 2022

(65) Prior Publication Data

US 2023/0043264 A1 Feb. 9, 2023

Related U.S. Application Data

(60) Provisional application No. 63/228,666, filed on Aug. 3, 2021.

(51) Int. Cl.
*B28D 7/04* (2006.01)
*B28D 1/04* (2006.01)

(52) U.S. Cl.
CPC ..... *B28D 7/04* (2013.01); *B28D 1/047* (2013.01)

(58) Field of Classification Search
CPC ... B23D 47/025; Y10T 83/75; Y10T 83/7507; B23Q 9/0028; B23Q 9/04; B28D 7/043; B27B 27/02; B27B 27/04; B27B 27/06; B27B 27/08; B27B 27/10
See application file for complete search history.

(56) References Cited

U.S. PATENT DOCUMENTS 1,938,548 A * 12/1933 Tauts ..... B23Q 1/74 83/438
5,038,486 A * 8/1991 Ducate, Sr. ..... B27B 29/00 83/435.14
2009/0084911 A1* 4/2009 Bergmann ..... B23D 47/02 248/440.1
2009/0084929 A1* 4/2009 Bergmann ..... B25H 1/06 248/676
2015/0298273 A1* 10/2015 Suhling ..... B23Q 16/08 269/74
2016/0101536 A1* 4/2016 Gundlach ..... B26D 1/085 83/468
2020/0147836 A1* 5/2020 Campuzano ..... B28D 1/225

* cited by examiner

*Primary Examiner* — Joel D Crandall
(74) *Attorney, Agent, or Firm* — Gurr Brande & Spendlove, PLLC; Robert A. Gurr

(57) ABSTRACT

A tile saw gauge has a receiver, an extension arm, and a slidable gauge. In one embodiment, the slidable gauge has one or more protrusions for fixing various lengths. The receiver may be permanently attached to a tile saw, such as by welding, or may removably attachable, such as by using screws, a bolt and nut, or similar mechanism. The tile saw gauge may be retrofitted on saws in the art, allowing tile saws in the market to make consistent cuts on larger tiles or tile lengths.

3 Claims, 10 Drawing Sheets

EXTENDED GAUGE FOR A TILE SAW

CROSS-REFERENCE TO RELATED APPLICATIONS

This application claims the benefit of U.S. Provisional Application Ser. No. 63/228,666, filed on Aug. 3, 2021, which is incorporated herein by reference.

TECHNICAL FIELD

The present disclosure relates to tile saws. More particularly, the present disclosure relates to a bracket that is couplable to an end of a tile saw to extend the length and overall gauge for the saw.

BACKGROUND

Tile saws have been used for many years to make cutting tile easier. Some tile saws include a guide to aid in measurements and repeat cuts. However, these guides do not account for the increasing size of tiles. For example, one current tile saw, the DeWalt 36000, marks up to 14 inches on the right side and 6 and ¾ on the left side. However, many tiles exceed these measurements, which means the guides are inadequate. For example, some tiles used in today's industry are 24 inches by 48 inches and others are 8 inches by 48 inches. Accordingly, the guides cannot be used with these tiles. As a result, if multiple cuts are needed, a user must mark each tile, which is time consuming and often less accurate than a typical guide.

Accordingly, there is a need for a tile saw gauge that accommodates the larger size of tiles used in the market, that is inexpensive, and that may be retrofitted onto existing tile saws. The present disclosure seeks to solve these and other problems.

SUMMARY OF EXAMPLE EMBODIMENTS

In some embodiments, a tile saw gauge comprises a receiver, an extension arm, and a slidable gauge. In one embodiment, the slidable gauge comprises one or more protrusions for fixing various lengths. The receiver may be permanently attached to a tile saw, such as by welding, or may be removably attachable, such as by using screws, a bolt and nut, or similar securing mechanism.

DETAILED DESCRIPTION OF EXAMPLE EMBODIMENTS

Figure 1:
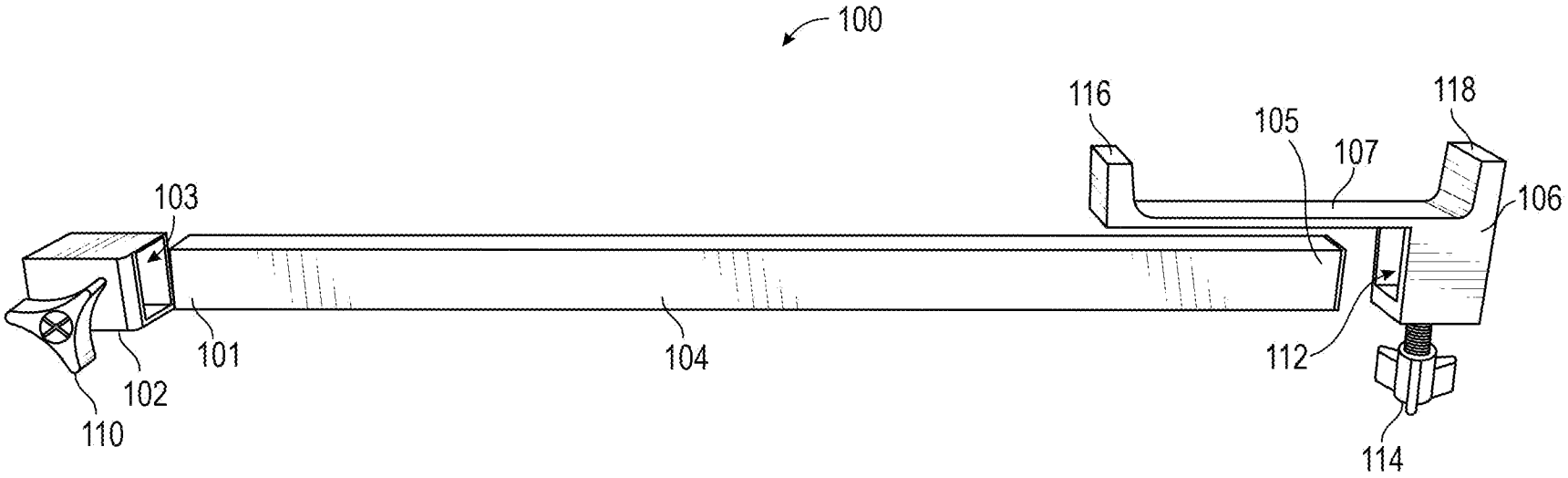
FIG. 1 illustrates a left side perspective view of a tile saw gauge in a disassembled position.
Figure 2:
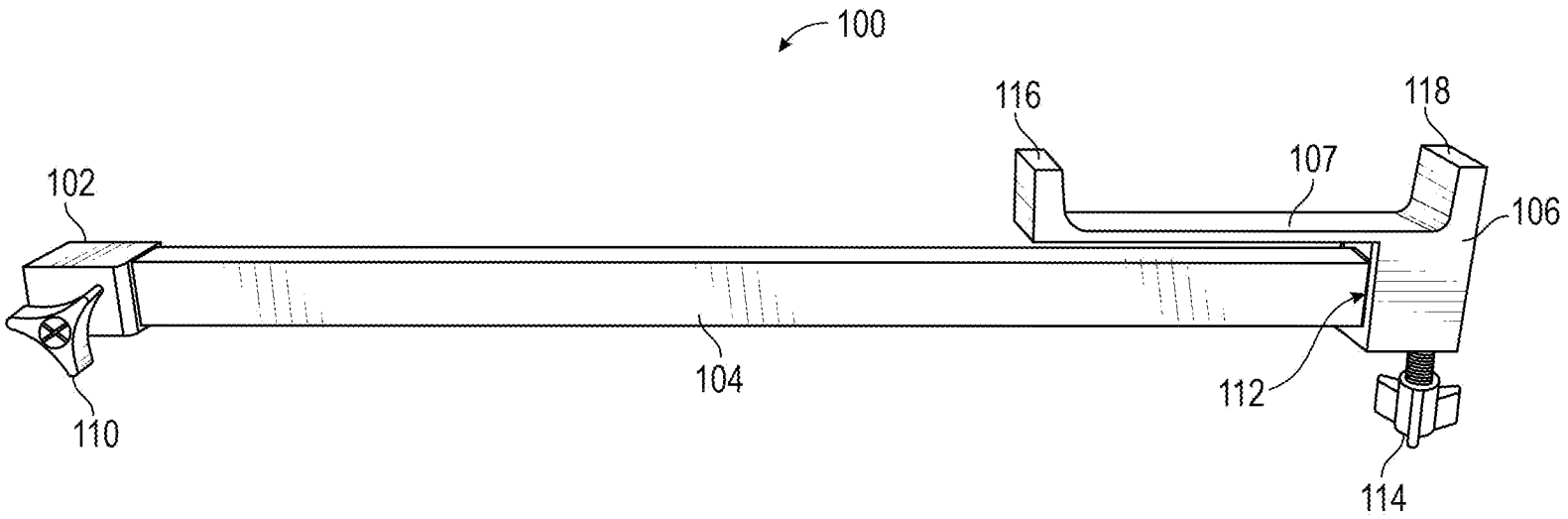
FIG. 2 illustrates a left side perspective view with the tile saw gauge in an assembled position of a first configuration.
Figure 3:
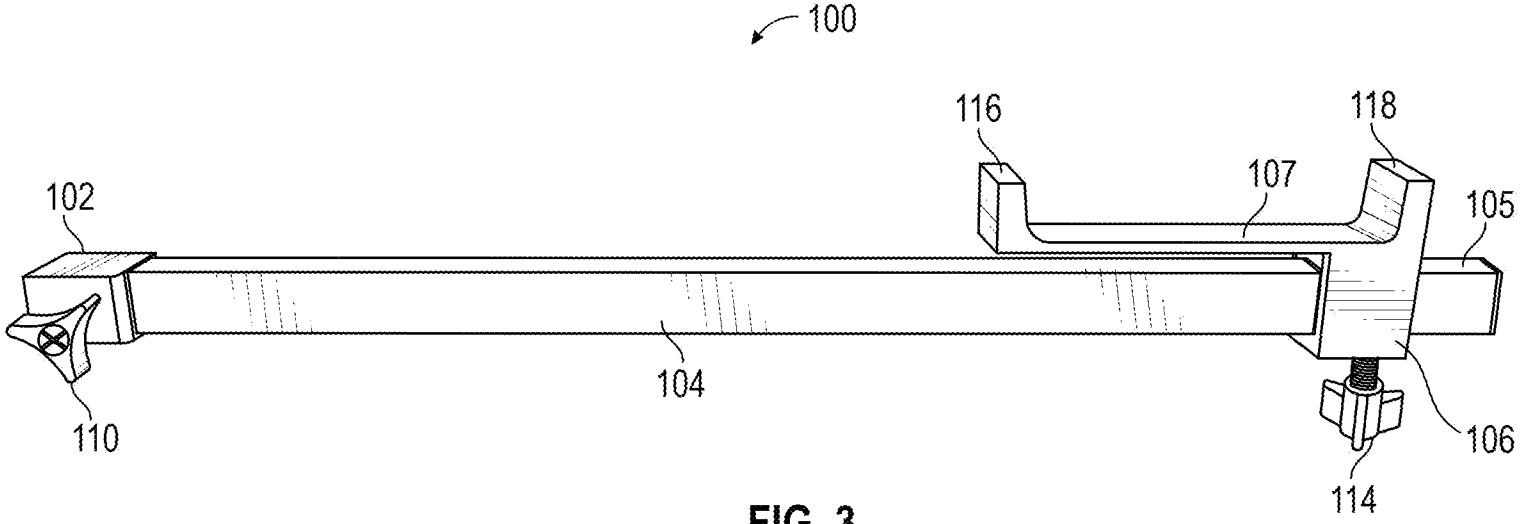
FIG. 3 illustrates a left side perspective view with the tile saw gauge in an assembled position of a first configuration.
Figure 4:
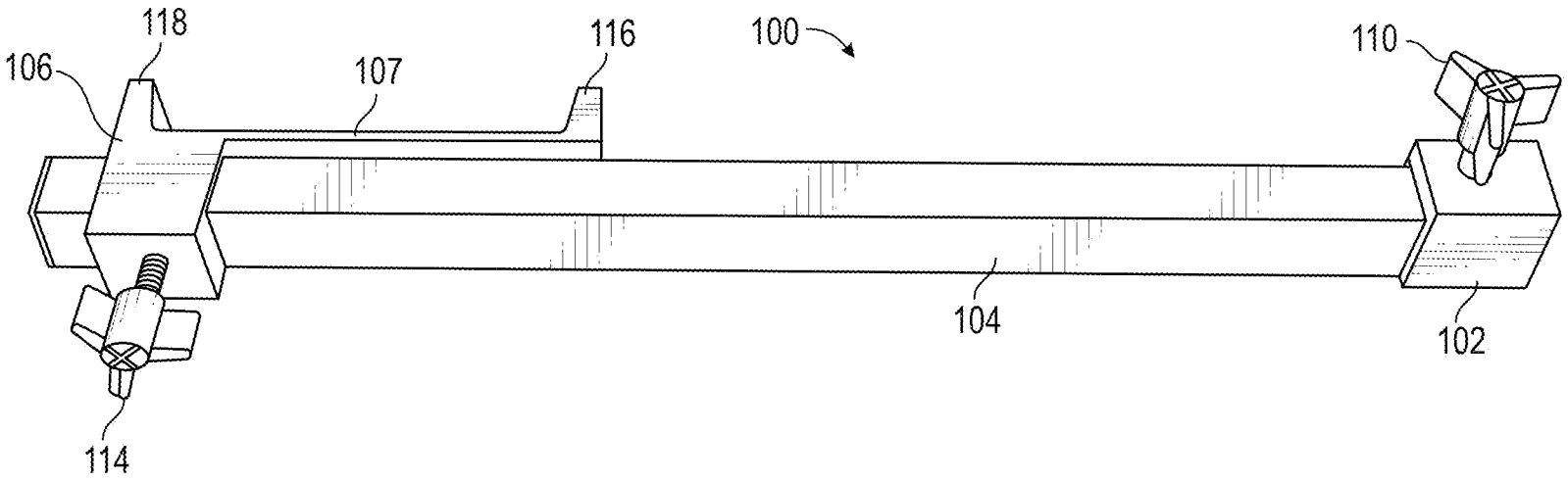
FIG. 4 illustrates a bottom, right side perspective view with the tile saw gauge in an assembled position of a first configuration.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a tile saw gauge that accommodates the larger size of tiles used in the market, that is inexpensive, and that may be retrofitted onto existing tile saws. The present tile saw gauge seeks to solve these and other problems.

Figure 5:
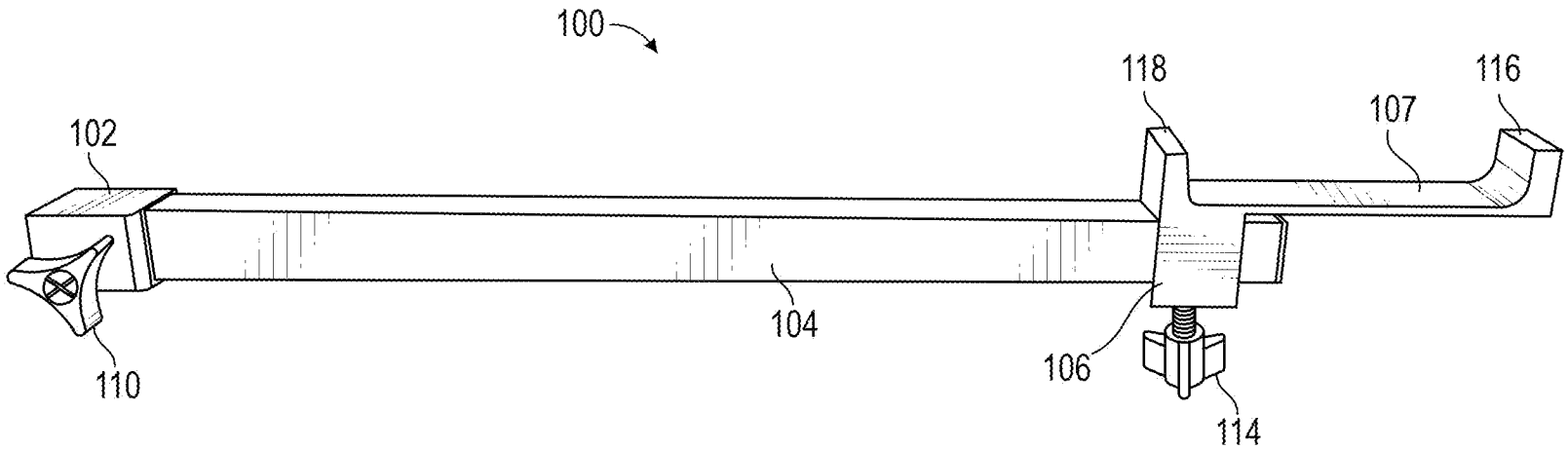
FIG. 5 illustrates a left side perspective view with the tile saw gauge in an assembled position of a second configuration.
Figure 6:
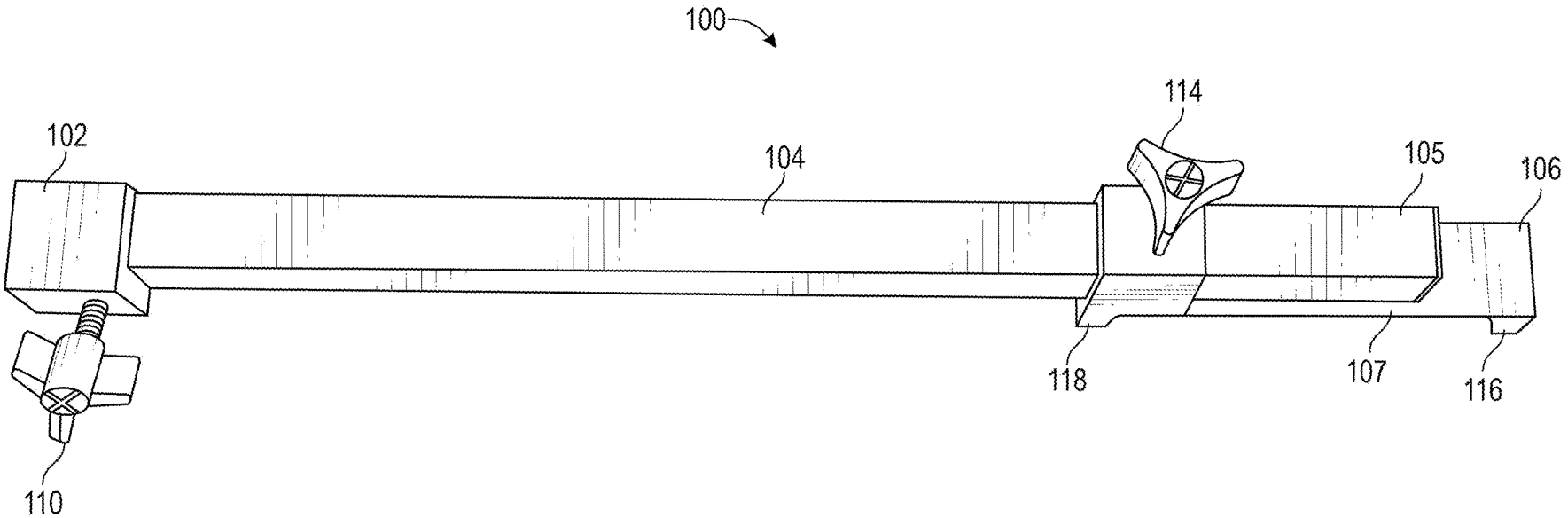
FIG. 6 illustrates a bottom perspective view with the tile saw gauge in an assembled position of a second configuration.
Figure 7:
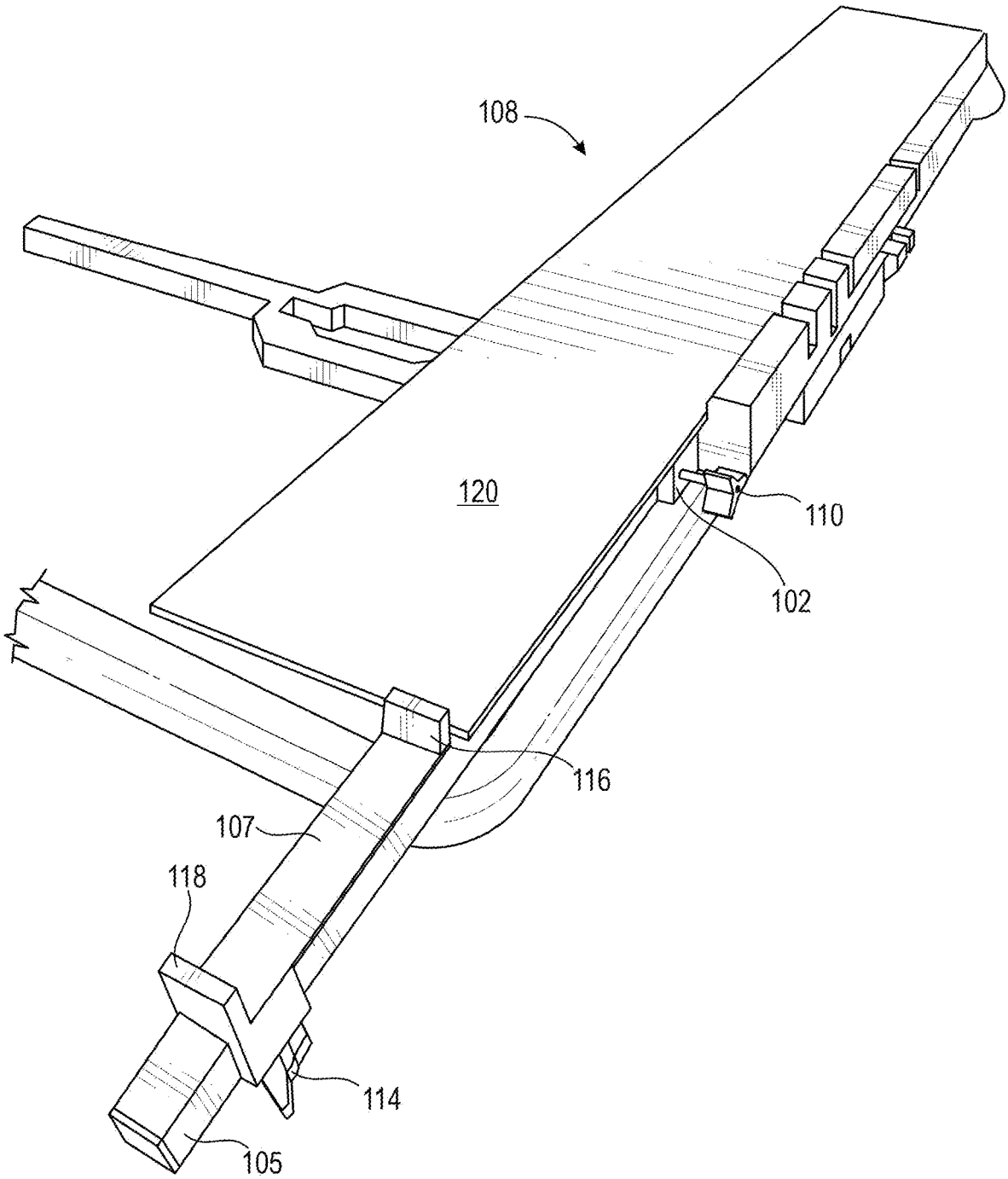
FIG. 7 illustrates a top perspective view of a tile saw gauge in a first configuration in use.
Figure 8:
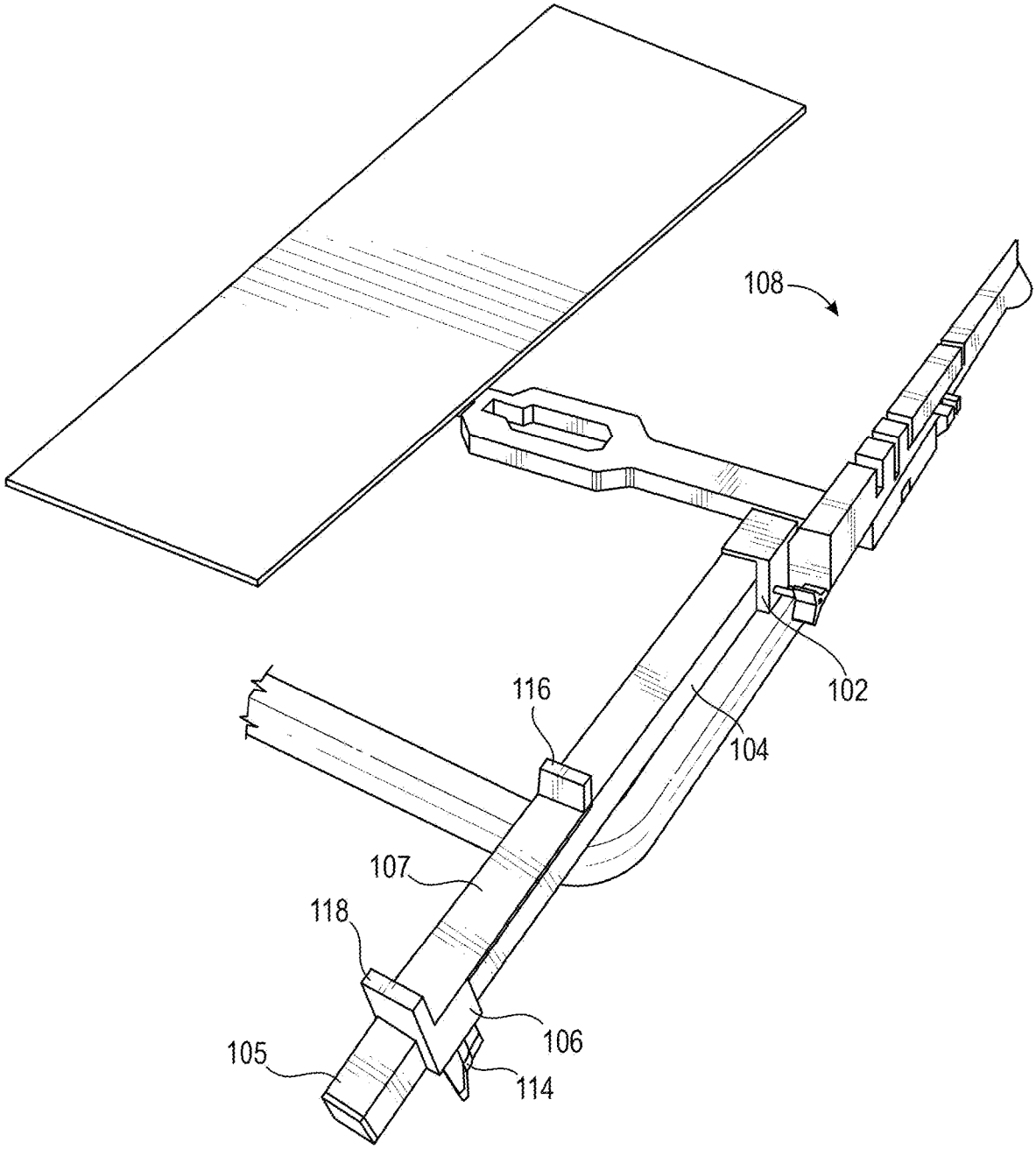
FIG. 8 illustrates a top perspective view of a tile saw gauge in a first configuration coupled to a tile saw.
Figure 9:
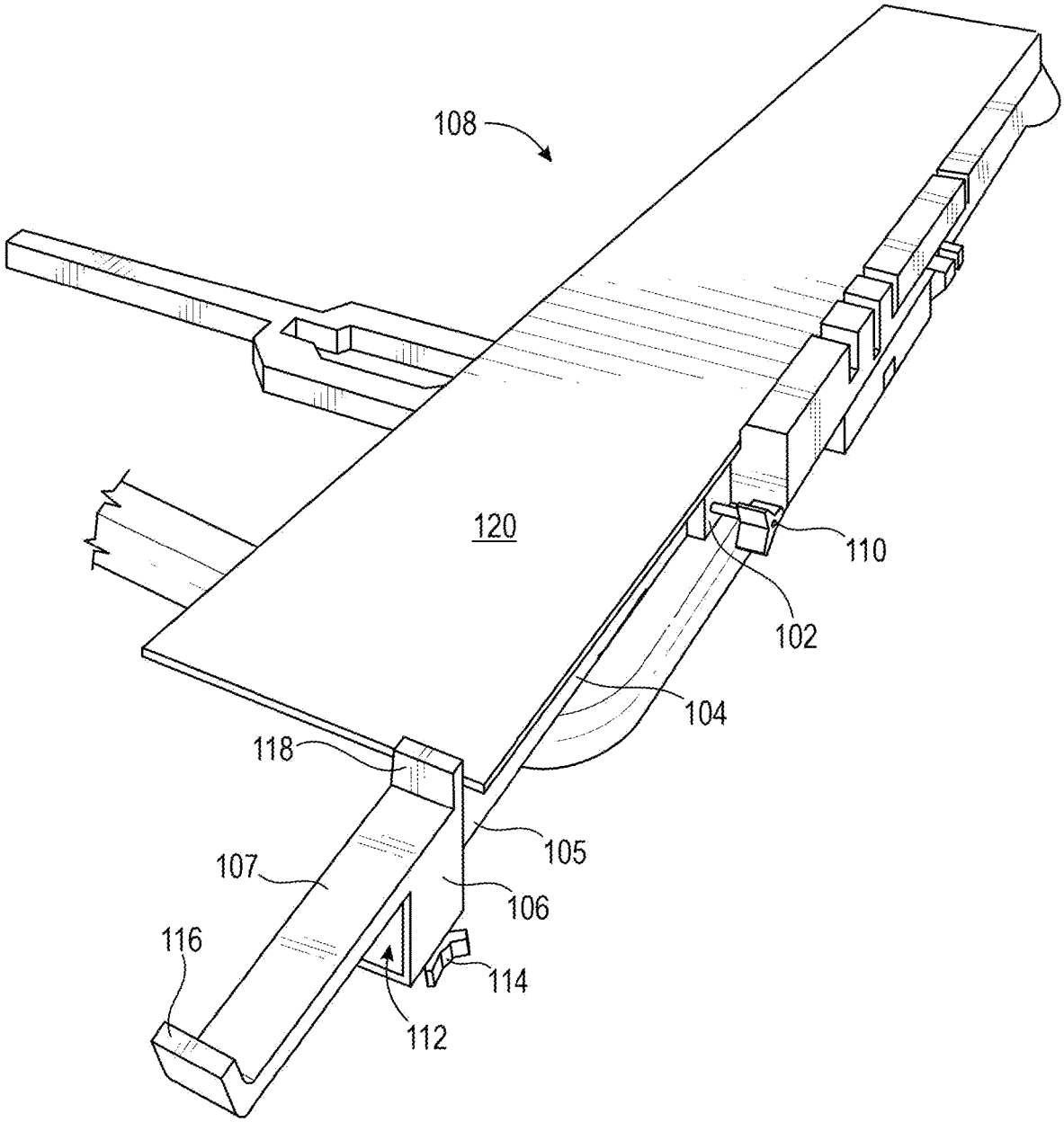
FIG. 9 illustrates a top perspective view of a tile saw gauge in a second configuration in use.

In some embodiments, as shown in FIGS. 1-9, a tile saw gauge 100 comprises a receiver 102, an extension arm 104, and a slidable gauge 106. The receiver 102 may be permanently attached/mounted to a tile saw, such as by welding, or may be removably attachable, such as by using screws, a bolt and nut, or similar mechanism on the tile saw frame 108 or other component of the tile saw. FIGS. 7-9 illustrate the receiver 102 coupled to the tile saw frame 108. Once attached or coupled to the tile saw frame 108, extension arm 104 may be coupled to the receiver 102 by inserting a first end 101 of the extension arm 104 into a receiving aperture 103 of the receiver 102.

Once received, the extension arm 104 may be secured to the receiver using a set screw 110 (which may be hand-actuated for ease of use) or similar mechanism. With the extension arm 104 coupled to the tile saw frame 108, the slidable gauge 106 may be utilized. In some embodiments, the slidable gauge 106 comprises a gauge aperture 112 that receives, and is slidable on, a second end 105 of the extension arm 104. Once the slidable gauge 106 has been positioned to the desired location on the extension arm 104, it may be secured to the extension arm 104 using a set screw 114 (or similar mechanism). It will be appreciated that the slidable gauge 106 may slide along the length of the extension arm 104 until the desired fitment is achieved for a given tile.

In some embodiments, as shown in FIGS. 1-9, the slidable gauge 106 comprises one or more protrusions 116, 118 that act as a stop for the tile. For example, the slidable gauge 106 may comprise a first protrusion 116 extending upwardly and generally perpendicular to the extension arm 104, which may be separated from a second protrusion 118 by an elongated base 107. The second protrusion 118 likewise extends upwardly from, and generally perpendicular to, the extension arm 104.

As shown in FIGS. 2-4 and 7, when a shorter length is needed, a user may place the slidable gauge 106 over the extension arm 104 in a first direction, allowing a first protrusion 116 to abut a tile 120 (FIG. 7) at a first position on the extension arm 104 (e.g., a shorter distance for shorter tiles). If the tile 120 is longer (exceeds the length of a tile saw in the art and extends along a length of the extension arm) or a longer cut is needed, the slidable gauge 106 may be reversed on the extension arm 104, as shown in FIGS. 5-6 and 9 so that the second protrusion 118 is used to abut and stop the tile 120, setting the cutting distance. In this configuration, the second protrusion 118 is located at a second position on the extension arm 104 (e.g., a longer distance for longer tiles), near the second end 105, allowing the tile 120 to rest on a majority of the length of the extension arm 104.

In some methods of use, a user would place a tile 120 on the tile saw frame and measure for the desired cut. Once measured, the user will place the slidable gauge 106 against the tile 120 and secure the slidable gauge into position using the set screw 114. The tile 120 may then be cut and each subsequent tile needing the same measurement can be cut without having to re-measure each tile. This makes the process much faster and accurate, with each tile having the same cut. As a result, the tile saw gauge 100 solves the need in the industry by accommodating larger tiles while remaining inexpensive and capable of being retrofitted on current tile saws.

Figure 10:
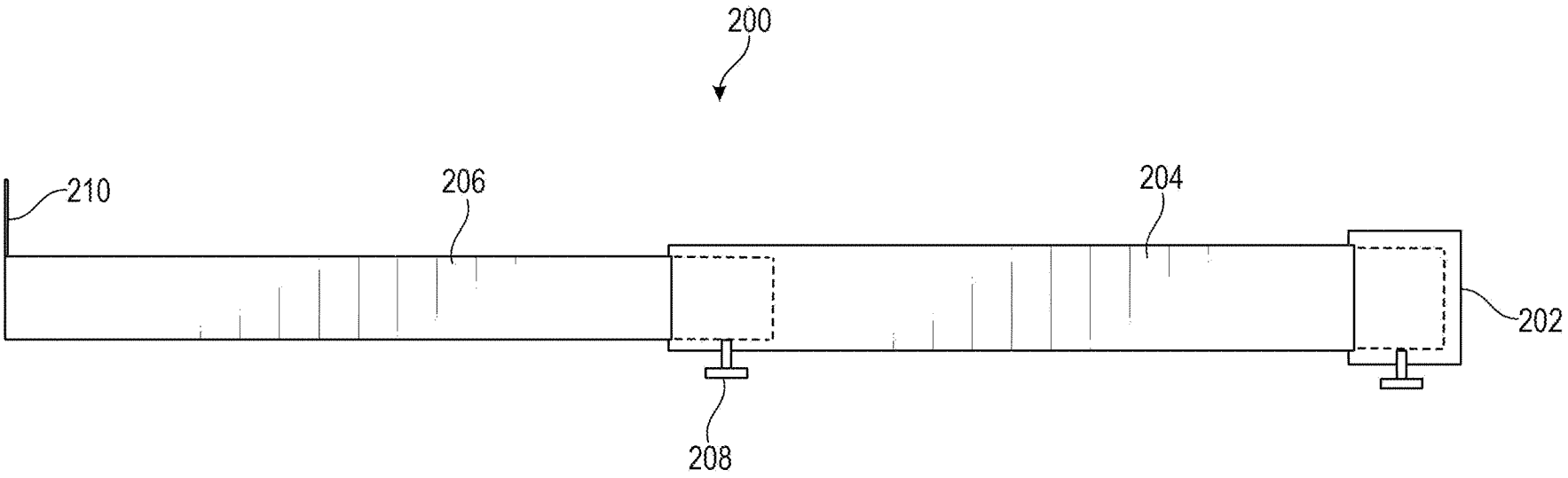
FIG. 10 illustrates a side elevation view of a tile saw gauge.

While the slidable gauge 106 was described herein as sliding on a fixed extension arm 104, it will be appreciated that other methods may likewise be used to achieve varying lengths, such as a telescoping arm with a protrusion at the end thereof. In such a scenario, the slidable gauge may be omitted. For example, as shown in FIG. 10, a tile saw gauge 200 comprises a receiver 202, a first extension arm 204, and a second, telescoping arm 206 (i.e., receivable within the first extension arm 204 and extending therefrom). The telescoping arm 206 may be secured at a desired length in relation to the first extension arm 204 using a set screw 208 or similar mechanism. The distal end of the telescoping arm 206 comprises a protrusion 210 for abutting a tile. As appreciated, the telescoping arm 206 may be lengthened or shortened as needed by simple telescoping action, and then secured using the set screw 208. While a set screw is described and shown, other methods may be used. For example, the telescoping arm 206 may be of a screw drive type, allowing for minute adjustments in length without the use of set screws. In such a scenario, the end protrusion 210 would be rotatably coupled to the distal end so as to remain upright despite the rotating of the screw drive.

In some embodiments, the telescoping arm 206 may comprise springs so as to ensure a snug fit against any given tile, although springs are not required.

Accordingly, it will be appreciated from the foregoing that the tile saw gauge 100, 200 disclosed herein solves the need for a tile saw gauge that accommodates the larger size of tiles used in the market, that is inexpensive, and that may be retrofitted onto existing tile saws.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. An extended gauge for a tile saw, comprising:

a receiver configured to couple to a tile saw frame, the receiver comprising a receiving aperture;

an extension arm comprising a first end configured to be receivable within the receiving aperture of the receiver;

a slidable gauge comprising:

a gauge aperture configured to receive a second end of the extension arm therethrough, a set screw positioned on a first side of the gauge aperture and configured to secure the extension arm within the gauge aperture, a first protrusion separated from a second protrusion by an elongated base, the first and second protrusions extending upwardly from the elongated base, the second protrusion opposite the set screw on a second side of the gauge aperture, the elongated base extending parallel to the extension arm.

2. The extended gauge for a tile saw of claim 1, wherein the receiver further comprises a set screw.

3. A method of using an extended gauge for a tile saw, the method comprising:

mounting a receiver to a tile saw frame;

coupling an extension arm to the receiver;

placing a tile on the tile saw frame and extending onto the extension arm;

measuring the tile to a predetermined length for cutting;

sliding a slidable gauge on the extension arm, the slidable gauge comprising a first protrusion separated from a second protrusion by an elongated base, wherein in a first position, the first protrusion abuts the tile and in a second position, the second protrusion abuts the tile;

securing the slidable gauge into position using a set screw positioned on a first side of a gauge aperture of the slidable gauge by securing the extension arm within the gauge aperture; and cutting the tile and any subsequent tile needing the same measurement.

* * * * *